US007347028B1

(12) United States Patent
Bin-Nun et al.

(10) Patent No.: US 7,347,028 B1
(45) **Date of Patent: *Mar. 25, 2008**

(54) MODULAR CONSTRUCTION SYSTEM UTILIZING VERSATILE CONSTRUCTION ELEMENTS WITH MULTI-DIRECTIONAL CONNECTIVE SURFACES AND RELEASABLE INTERCONNECT ELEMENTS

(75) Inventors: Rifael Bin-Nun, Teaneck, NJ (US); Rebecca Neugroschl, Bergenfield, NJ (US); Ari Neugroschl, Bergenfield, NJ (US)

(73) Assignee: Inspired Child, Inc., Bergenfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/694,723

(22) Filed: Mar. 30, 2007

Related U.S. Application Data

(63) Continuation of application No. 11/682,880, filed on Mar. 7, 2007.

(51) Int. Cl.
*E04C 1/00* (2006.01)
*A63H 33/04* (2006.01)

(52) U.S. Cl. ..... 52/271; 52/284; 52/604; 52/582.1; 52/586.2; 446/112; 446/120; 446/122; 446/124

(58) Field of Classification Search ..... D21/484, D21/500, 501, 502; 446/85, 111, 112, 117, 446/120, 121, 122, 124–126, 128; D25/113; 52/270, 271, 284, 604, 585.1, 586.1, 582.1, 52/586.2; 403/292, 300
See application file for complete search history.

(56) References Cited

U.S. PATENT DOCUMENTS 3,005,282 A * 10/1961 Christiansen ..... 446/128
4,003,144 A * 1/1977 Maddestra et al. ..... 434/403
4,676,762 A 6/1987 Ballard
4,744,780 A * 5/1988 Volpe ..... 446/128
5,609,435 A * 3/1997 Nomura ..... 403/387
5,795,210 A * 8/1998 Kushner et al. ..... 446/128
6,568,981 B1 5/2003 Chang
2003/0000155 A1* 1/2003 Zwerenz ..... 52/79.9

FOREIGN PATENT DOCUMENTS

DE 36 02 630 A1 * 7/1987

* cited by examiner

*Primary Examiner*—Robert Canfield
(74) *Attorney, Agent, or Firm*—Edward Etkin, Esq.

(57) ABSTRACT

A modular construction system that utilizes versatile construction components releasably attachable to one another, in virtually any desired direction, by use of one or more interconnect components positioned therebetween. Each construction component includes at least two inventive connective surfaces with a receiving region therein, while each interconnect component includes at least one coupling surface comprising multiple coupling elements capable of releasable frictional engagement with at least a portion of one or more receiving regions. The receiving regions, the interconnect components, and the coupling elements are sized and configured to (1) enable a first type of connection in which at least a portion of an interconnect component fits within and releasably connects overlapping connective surfaces of two construction components, and (2) optionally also enable a second type of connection, in which construction components are connected by an interconnect component that releasably engages with two or more proximal connective surfaces positioned and aligned in the same plane In one inventive embodiment, the receiving regions of the construction components are sized and configured to enable releasable coupling with male studs of conventional popular toy building blocks.

14 Claims, 12 Drawing Sheets

(Example)

(Example)

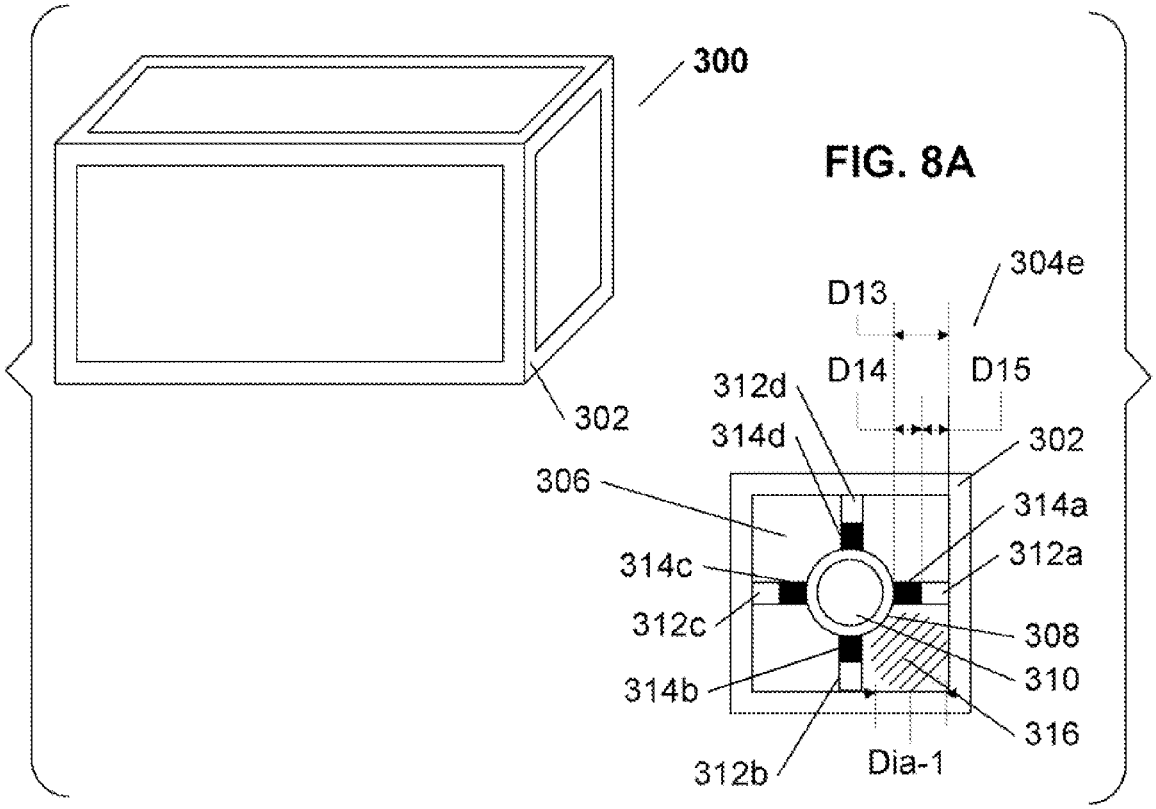
FIG. 8A
FIG. 8B
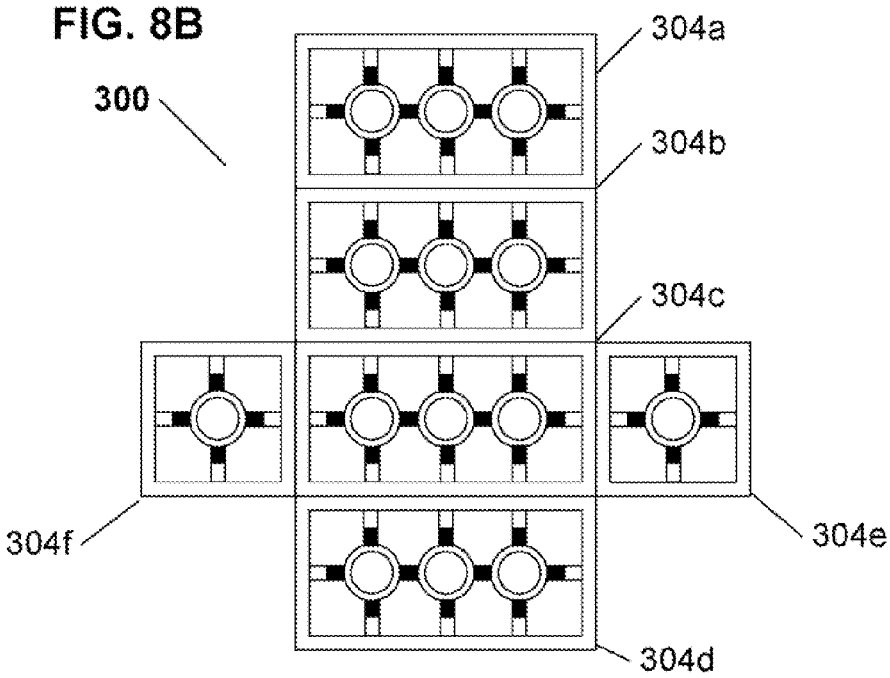

(Example)

FIG. 9A (Example)
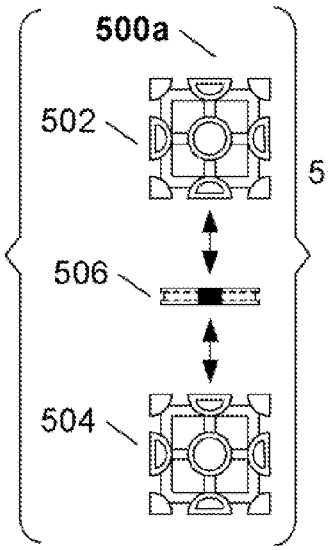
FIG. 9B (Example)
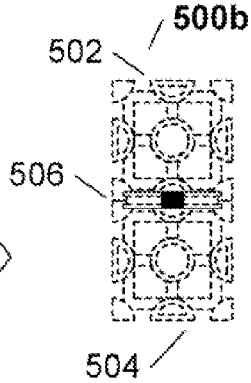
FIG. 10A (Example)
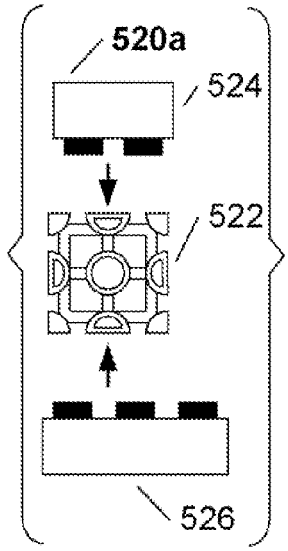
FIG. 10B (Example)
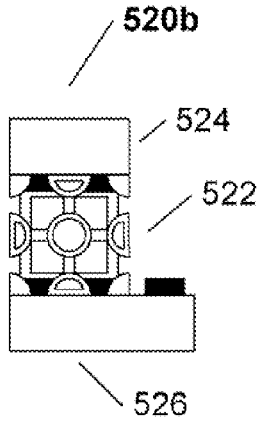
FIG. 9C (Example)
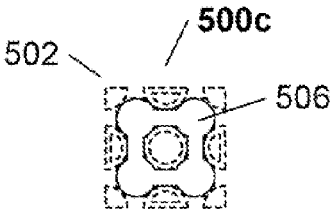
FIG. 11 (Example)
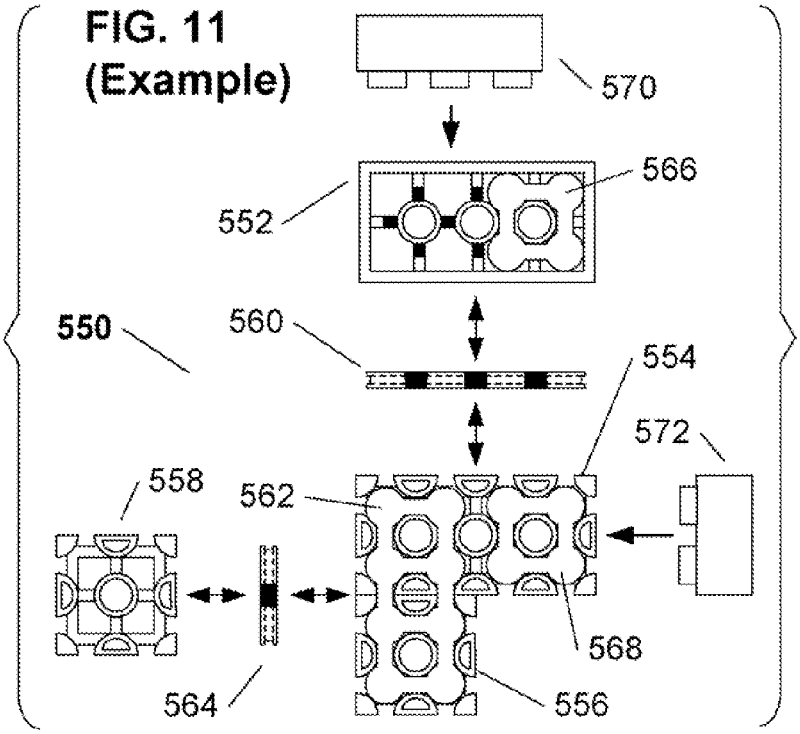

(Example)

FIG. 13A (PRIOR ART)
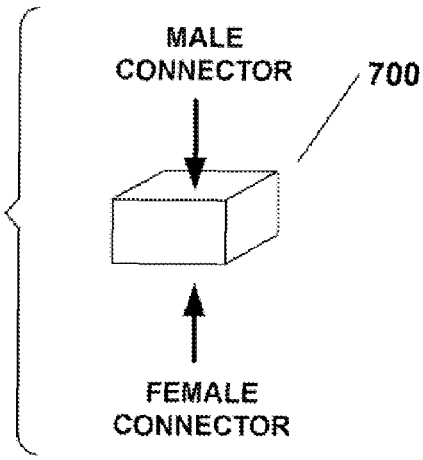
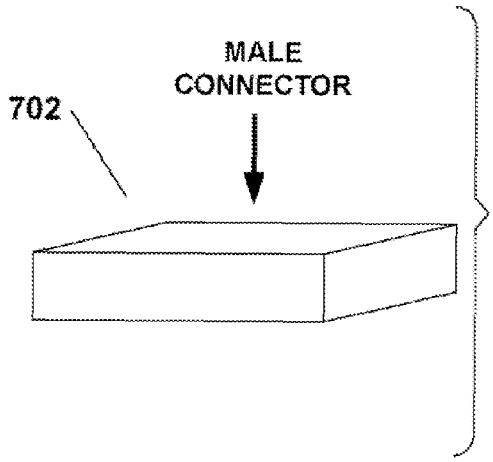
FIG. 13B (PRIOR ART)
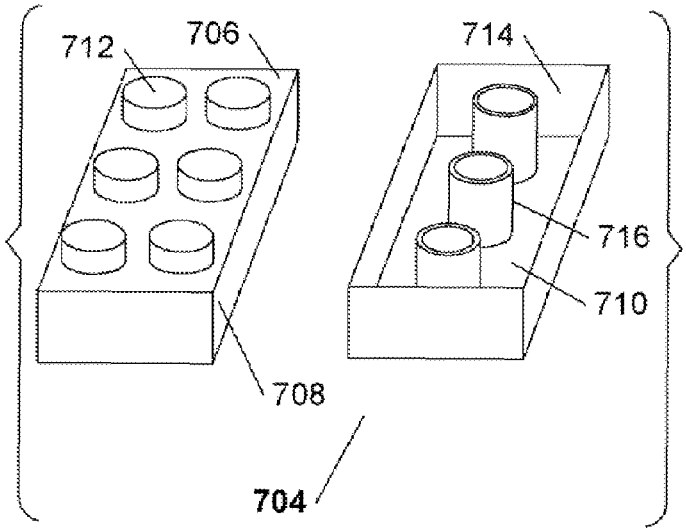
FIG. 14 (PRIOR ART)
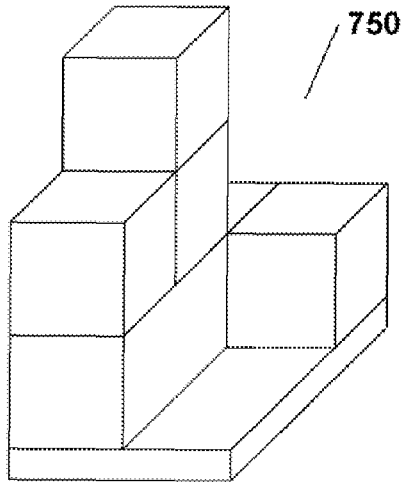

MODULAR CONSTRUCTION SYSTEM UTILIZING VERSATILE CONSTRUCTION ELEMENTS WITH MULTI-DIRECTIONAL CONNECTIVE SURFACES AND RELEASABLE INTERCONNECT ELEMENTS

CROSS REFERENCE TO RELATED APPLICATION

The present patent application is a continuation of the commonly assigned co-pending U.S. patent application Ser. No. 11/682,880, entitled "Modular Construction System Utilizing Versatile Construction Components With Multi-Directional Connectivity and Releasable Interconnect Components", filed on Mar. 30, 2007.

FIELD OF THE INVENTION

The present invent on relates generally to modular construction systems utilizing multiple construction components, and more particularly to a modular construction system utilizing multiple versatile construction components releasably connectable to one another in a variety of connection configurations utilizing corresponding interconnect components.

BACKGROUND OF THE INVENTION

Various construction systems (also referred to as construction sets and building sets) that utilize multiple releasably connectable components have been in popular use for many years in different applications ranging from toys to consumer and commercial furnishings, to architectural building systems. As a result, a great number of previously developed solutions are available for each type of construction system depending on the intended use thereof.

However, regardless of application, all previously developed construction systems can be separated into two basic categories: "Category-1" systems with construction components that directly releasably interconnect with one another in a strictly predefined manner, and "Category-2" systems with construction components that require one or more connector elements for releasable connection therebetween in one or more predetermined positions.

Referring now to FIG. 13A, many of the previously known Category-1 construction systems comprise building block sets with the majority of the blocks being substantially equivalent to block 700 having one surface with male coupling connectors, and an opposing surface with female receiving connectors (such as a female receiving region), sized and configured for releasable frictional engagement with male coupling connectors inserted therein. Category-1 sets may also include blocks with male-only coupling connectors (such as block 702), for use as a base, or in other applications where a flat surface connected to one or more building blocks is needed.

Examples of the most common Category-1 construction systems include the toy building block sets of the LEGO® brand. Top and bottom isometric views of an exemplary construction component used in such toy building block sets are shown in FIG. 13B, as the block 704, on the outside having a male connector surface 706 with several connector studs 712, and having outer walls 708, and on the insider having a female receiving region 710, bounded by inner walls 714 and including a number of cylindrical projections 716, positioned along the central longitudinal axis, to form plural female connective regions between the projections

716 and the inner walls 714, sized and configured to frictionally engage the studs 712 when they are brought into coupling connection therewith. The female receiving region may include a number of additional engaging elements, such as ribs along the inner walls 714, to assist in achieving frictional engagement with the male studs 712.

While Category-1 construction sets may be supplied with individual "special" elements that allow specific predefined non-conventional connective configurations, the vast majority of "average" building elements are variations of the block 704, that may differ in size, but that are connectable to one another only through engagement of at least a portion of each block's male connector surface with at least a portion of corresponding female connective regions of another block or blocks. Therefore, utilizing the commonly supplied average building elements, a conventional Category-1 construction system only enables blocks to be connectively stacked, as illustrated by an exemplary structure 750 of FIG. 14, constructed utilizing blocks substantially similar to blocks 700 and 702.

Notwithstanding their popularity, the most commonly supplied "average" building blocks of Category-1 toy construction sets suffer from a number of disadvantages. First and foremost, there are very significant limitations on the how such building blocks can be releasably connected to one another—i.e., the blocks can only be connected in a stacking fashion, with the male coupling connectors of at least a portion of the blocks being in releasable engagement with female receiving connectors of another portion of the blocks. This serious flaw severely inhibits the creativity of a person (e.g., a child) playing with the construction set, by forcing them to use the building elements in a very specific manner.

Another drawback of the majority of Category-1 building blocks is the relative weakness of coupling force between smaller and significantly larger interconnected blocks, and of the stability of their orientations with respect to one another. A number of solutions have been proposed to address the drawbacks related to weakness of the coupling force and of the stability of orientation (such as taught in U.S. Pat. No. 6,554,676, entitled "Toy building set", and U.S. Pat. No. 5,795,210, entitled "Toy building set and building elements therefor"). Nevertheless, the inherent structure and construction of the majority of commonly used Category-1 building blocks eliminates the possibility of expanding the range of connectivity of the blocks to one another, and thus, the key limitation of such building blocks remains unresolved.

To address at least some of the above-described connectivity limitations alternate types of Category-1 construction systems have been proposed. For example, U.S. Pat. No. 5,458,522, entitled "Fabric fastener building block", disclosed a construction set composed of building blocks each having fabric hook regions covering at least a portion of its surfaces, and fabric loop regions, capable of releasable attachment to fabric hook regions, covering another portion of its surfaces, and in another proposed variations, certain blocks included only hook fabric surfaces, while other blocks included only loop fabric surfaces. While this solution offered a greater range of connectivity than the above-described stackable building blocks, it still suffered from a number of flaws. First, while their orientation with respect to one another was flexible, to connect the blocks, one must match hook fabric surfaces to corresponding loop fabric surfaces. Thus, two blocks having the same type of fabric surface could not be connected to one another. Therefore the connectivity limitations were not fully addressed. Second, the nature of hook and loop fabric coupling imposed practical minimum values on the sizes of the building blocks (which had to be much greater than previously described conventional stackable blocks), and also greatly reduced the block-to-block coupling force, when many fabric-covered blocks were connected to one another.

To better address the connectivity limitations of Category-1 construction systems, a number of other solutions were developed that removed the limitations on directionality of coupling multiple building elements—i.e. by proposing "Category-2" construction systems with construction components that require one or more connector elements for releasable connection therebetween in one or more predetermined positions. For example, a number of proposed Category-2 solutions, disclosed building components having a hole positioned in each side that are connectable utilizing dowel-like interconnect components that are inserted in each respective hole of the components being connected (e.g., such as disclosed in U.S. Pat. No. 5,924,906, entitled "Pin connector for construction toy set"). Another similar proposed solution disclosed in U.S. Pat. No. 5,281,185, entitled "Universal foldable toy blocks with alignable slots" taught the use of slots positioned on the surfaces of construction components and flat interconnect components insertable therein to form releasable attachment between the components.

However, while these solutions address the limitations of directionality of coupling between construction components, they suffer from a different set of drawbacks. First, the use of holes or slots with corresponding rod or flat inserts require predetermined precise alignment of construction components such that the respective holes or slots exactly face one another. Second, inserting multiple elongated coupling connectors into precisely aligned holes or slots is a relatively time-consuming and frustrating task, limiting the appeal of such solutions. In addition, it is very difficult to control the coupling force of such releasable interconnect solutions.

Yet another set of proposed solutions for Category-2 construction systems, taught the use of resilient core construction blocks having surfaces covered with loop fabric and a number of engaging double-sided tabs having hook fabric surfaces to releasably attach the blocks to one another in a variety of configurations (e.g., as disclosed in U.S. Pat. Nos. 5,964,634 and 6,568,981, both entitled "Soft brick modular building construction set"). Nevertheless, even these solutions had serious flaws. First, while acceptable to couple proximal surfaces of the blocks aligned in the same plane, the double-sided tabs were problematic when used between facing surfaces of the blocks, as they prevented the blocks from coming into full contact with one another, making such connections inherently unstable and weakened, especially if multiple blocks were interconnected. In addition, as noted above, with respect to the '522 patent, the nature of hook and loop fabric coupling imposed practical limitations on the sizes of the construction blocks (which had to be of much greater size than previously described conventional stackable blocks).

Finally, there are two important disadvantages common to all solutions proposed to address the flaws of conventional stackable block Categroy-1 construction systems. First, the proposed construction systems are almost uniformly proprietary, and thus do not offer any solutions for use with the vastly popular stackable block construction sets—likely the cause of their failure to gain significant acceptance. Second, the vast majority of the more flexible previously known Category-2 construction systems are very limited in their scalability—for example, the various construction systems that utilize hook and loop fabric for releasably connecting the blocks have a size limitation defined by the strict requirements imposed by the availability of a very limited size range of hook and loop fabric options. Similarly, construction systems that utilize such elements as connecting rods (e.g., as proposed in the '906 patent), may be made relatively small, but quickly become unwieldy and cumbersome when produced on a larger scale.

It would thus be desirable to provide an modular construction system comprised of versatile construction components capable of connectivity in any cardinal direction, and utilizing interconnect components with significant flexibility in their use to releasably couple the versatile construction components in a variety of connection configurations. It would also be desirable to provide a modular construction system readily scalable in utilization from toy to architectural applications. It would further be desirable to provide a modular construction system comprised of versatile construction components, and interconnect components capable of fitting within an overlap region formed by connected construction components, to enable substantially flush interconnection thereof. It would additionally be desirable to provide a modular construction system, having construction components sized and configured to releasably engage with male coupling connectors of commercially available toy construction blocks and having interconnect components sized and configured to releasably engage with female receiving connectors of the toy construction blocks. It would further be desirable to provide a modular construction system that has readily scalable construction and interconnect components.

BRIEF DESCRIPTION OF THE DRAWINGS

In the drawings, wherein like reference characters denote corresponding or similar components throughout the various figures:

FIGS. 8A to 8B are schematic diagrams showing an alternate exemplary embodiment of the versatile construction component of FIG. 1A in which the construction component comprises integral connective surfaces, where each integral connective surface may only be coupled to other connective surfaces utilizing at least one interconnect component that fits entirely within the region defined by the outer boundaries of the integral connective surface;

FIGS. 9A-9C are exemplary schematic diagrams showing different views illustrating an exemplary releasable connection of two versatile construction components of FIGS. 6A-6C to one another utilizing the interconnect component of FIG. 4A;

FIGS. 10A-10B are exemplary schematic diagrams showing different views illustrating an exemplary releasable connection of a versatile construction component of FIGS. 6A-6C to two different predetermined conventional toy building elements having coupling studs disposed on one of their surfaces;

FIG. 11 is an exemplary schematic diagram illustrating an exemplary releasable connection of multiple versatile construction components of FIGS. 6A-6C, a versatile construction component comprising at least two connective surfaces of FIG. 5G and at least two connective surfaces of FIG. 5I, and a construction component of FIGS. 8A-8B, utilizing multiple interconnect components of FIGS. 4A and 4B, and also illustrating releasable connection between multiple predetermined conventional toy building elements having coupling studs disposed on one of their surfaces to different connective surfaces of various inventive construction components;

FIGS. 13A to 13B are diagrams illustrating perspective views of a previously known building elements having a female and/or male connective region; and FIG. 14 is a diagram illustrating a perspective view of an exemplary structure constructed utilizing the previously known building elements shown in FIGS. 13A-13B.

SUMMARY OF THE INVENTION

Figure 1A:
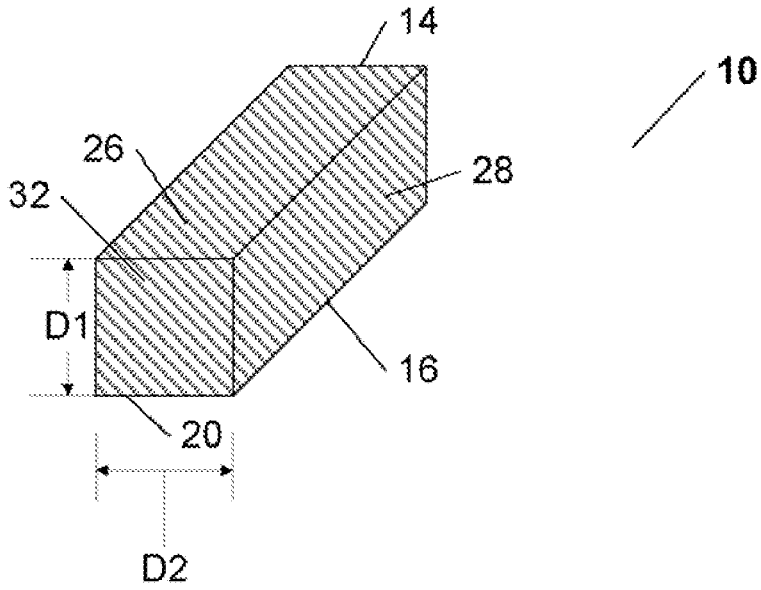
FIG. 1A is a diagram showing a perspective view of a first exemplary embodiment of a versatile construction component of a first embodiment of the inventive modular construction system, having multiple connective surfaces.

The present invention is directed to a modular construction system, that utilizes versatile construction components that are releasably attachable to one another in virtually any desired direction, by use of one or more interconnect components. Each inventive construction component includes at least two connective surfaces, each oriented in any desired direction, and each having a receiving region therein, while each interconnect component includes at least one coupling surface comprising multiple coupling elements capable of releasable frictional engagement with at least a portion of one or more of the receiving regions.

In accordance with the present invention, the receiving regions, the interconnect components, and the coupling elements, are preferably sized and configured to enable a first type of connection in which at least a portion of an interconnect component fits within and releasably connects overlapping connective surfaces of two construction components, by frictionally engaging at least a portion of each of the receiving regions within the overlapping connective surfaces. In the preferred embodiment of the present invention, the receiving regions, the interconnect components, and the coupling elements, are preferably sized and configured to also enable a second type of connection in which proximal construction components are connected by an interconnect component that releasably engages with at least portions of each of two or more proximal connective surfaces of the construction components, that are positioned and aligned in the same coordinate plane.

In one embodiment of the present invention, the inventive connective surfaces may either be planar elements applied to substantially flat outer surfaces of a solid, hollow, and/or filled construction component, or alternately they may be an integral part of the structure of a construction component. In another embodiment of the invention, at least one connective surface may be formed by plurality of cavity elements arranged in a desired predefined pattern.

In yet another inventive embodiment, the receiving regions are sized and configured to enable releasable coupling with male studs of conventional popular toy building blocks, while the interconnect components are sized and configured to releasably connect to appropriately sized female receiving regions of such building blocks.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF PREFERRED EMBODIMENTS

The inventive modular construction system remedies all of the disadvantages of previously known construction systems that utilizing construction components that are releasably connectable to one another directly, or through use of one or more interconnect components, by providing versatile construction components that each include at least two inventive connective surfaces each having a respective receiving region therein, and each positioned to support connectivity in any desired direction, and by providing interconnect components, each including at least one coupling surface comprising multiple coupling elements capable of releasable frictional engagement with at least a portion of one or more receiving regions. The receiving regions, the interconnect components, and the coupling elements, are preferably sized and configured to enable a first type of connection in which at least a portion of an interconnect component fits within and releasably connects overlapping connective surfaces of two construction components, by frictionally engaging at least a portion of each of the receiving regions within the overlapping connective surfaces. In the preferred embodiment of the present invention, the receiving regions, the interconnect components, and the coupling elements, are preferably sized and configured to also enable a second type of connection in which proximal construction components are connected by an interconnect component that releasably engages with at least portions of each of two or more proximal connective surfaces of the construction components, that are positioned and aligned in the same coordinate plane.

At the outset, it should be noted that several embodiments of the inventive construction and interconnect components are shown in a number of drawing figures herein as being sized and configured to releasably connect to at least a corresponding male or female portion of a commercially available previously known toy building element, by way of example only. The inventive versatile construction and interconnect components are readily scalable to any desired size for use in various applications, as a matter of design choice, without departing from the spirit of the invention. Thus, appropriately sized inventive construction and interconnect components may be used in architectural, civil, or military engineering or construction applications, or used to build utility structures, such as furnishings, as shown and described below in, by way of example, in connection with FIG. 12.

Figure 1B:
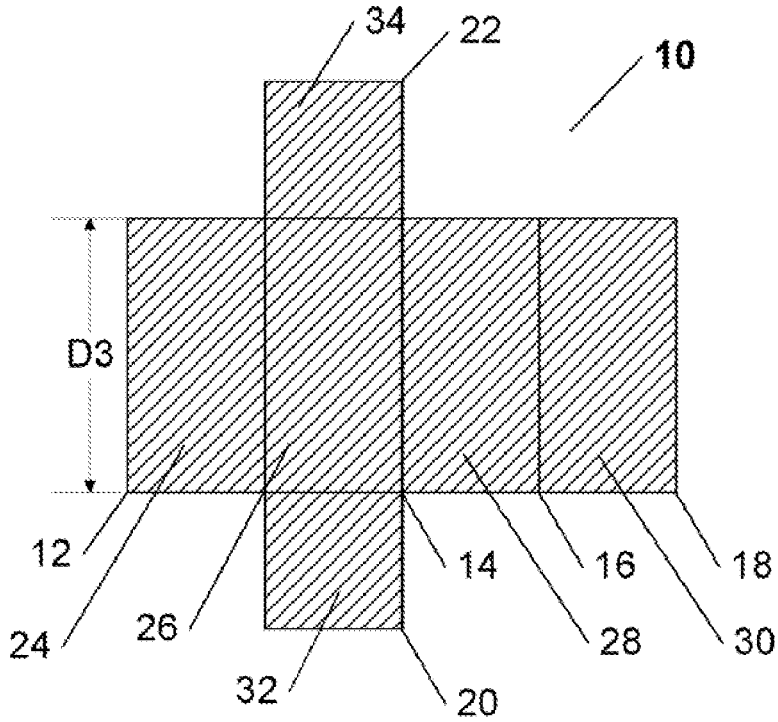
FIG. 1B is a schematic diagram showing a foldout view of the versatile construction component of FIG. 1A.

Prior to describing the preferred embodiments of the components of the inventive modular construction system, it would be helpful to provide an overview of the basic principles of the present invention. Referring now to FIGS. 1A-1B, a first exemplary embodiment of an inventive versatile construction component 10 is shown in isometric and fold-out views. While the versatile construction component 10 is shown as being generally brick-shaped, it should be noted, that as a matter of design choice, the construction component 10 may be a cube, or any geometric shape, having at least flat two surfaces at a predefined angle to one another. Therefore, the dimensions D1 to D3 of the construction component 10 may be readily selected as a matter of design choice, provided that each of the dimensions D1 to D3 are proportional to one another.

The construction component may include six connective surfaces 12-22 of a single predefined type, corresponding to each of its outer surfaces, where each connective surface 12-22 comprises a corresponding receiving region 24-34. Preferably, each receiving region 24-34 extends through the outer edge of each corresponding connective surface 12-22, and each forms a cavity therein.

The construction component 10 may be composed of any rigid and/or resilient material, and each of the connective surfaces 12-22 is preferably composed of any at least minimally resilient material, such as plastic, polymer foam, rubber, etc. In addition, the construction component 10 may be solid, fully or partially hollow, fully or partially filed with one or more substances, and/or may include an internal skeletal support structure (not shown).

While the construction component 10 is shown as having a corresponding connective surface 12-22 on each of its outer surfaces, construction component 10 can include two or more connective surfaces on any two or more of its outer surfaces as a matter of design choice, without departing from the spirit of the invention. If less than six connective surfaces are present, each of the remaining outer surfaces may be one or more of: a solid plane, an opening (if the construction component 10 is hollow or partially hollow), an additional structure, or another type of connector.

Figure 1C:
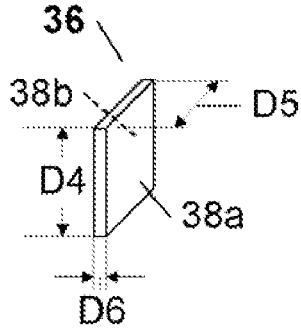
FIG. 1C is a diagram showing a perspective view of a first exemplary embodiment of a releasable interconnect component for use in conjunction with the versatile construction component of FIG. 1A, capable of releasably connecting multiple versatile construction components.

Referring now to FIG. 1C, a first exemplary embodiment of a releasable interconnect component 36 is shown. The interconnect component 36 is preferably substantially planar, and includes a coupling surface 38*a* on one planar side, and a second coupling surface 38*b* on the other planar side, and oriented in an opposite direction of the coupling surface 38*a*. Preferably, each of the coupling surfaces 38*a* and 38*b* are sized and configured by appropriate selection of the dimensions D4 to D6 to partially enter and frictionally engage at least a portion of a corresponding receiving region of each of two proximal construction components having overlapping connective regions therebetween, to enable a releasable coupling connection between (examples of such releasable connections between multiple construction components are shown and described below in connect on with FIGS. 2A-2B). In particular, preferably the dimension D6 is approximately twice the depth of the corresponding cavity of each of the receiving regions 24-34.

Figure 1D:
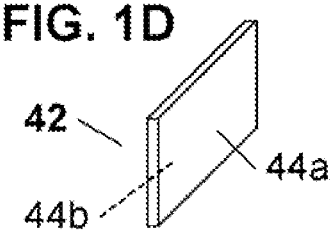
FIG. 1D is a diagram showing a perspective view of an alternate exemplary embodiment of a releasable interconnect component for use in conjunction with the versatile construction component of FIG. 1A, capable of releasably connecting multiple versatile construction components.

Depending on the selection of dimensions D4 and D5, the interconnect component 36 may be a square, a rectangle, or it may be of any geometric shape having at least four 90 degree corners. Referring now to FIG. 1D, an exemplary alternate embodiment of the interconnect component 36 is shown as an elongated interconnect component 42 having opposed coupling surfaces 44*a* and 44*b*. The advantage of an elongated interconnect component 42 is that it may be utilized to readily connect two or more construction components that are positioned sufficiently close to one another, with each having a receiving region oriented in the same coordinate plane as the others such that the interconnect component 42 may be used to partially enter and frictionally engage at least a portion of each of the oriented receiving regions.

Figure 2A:
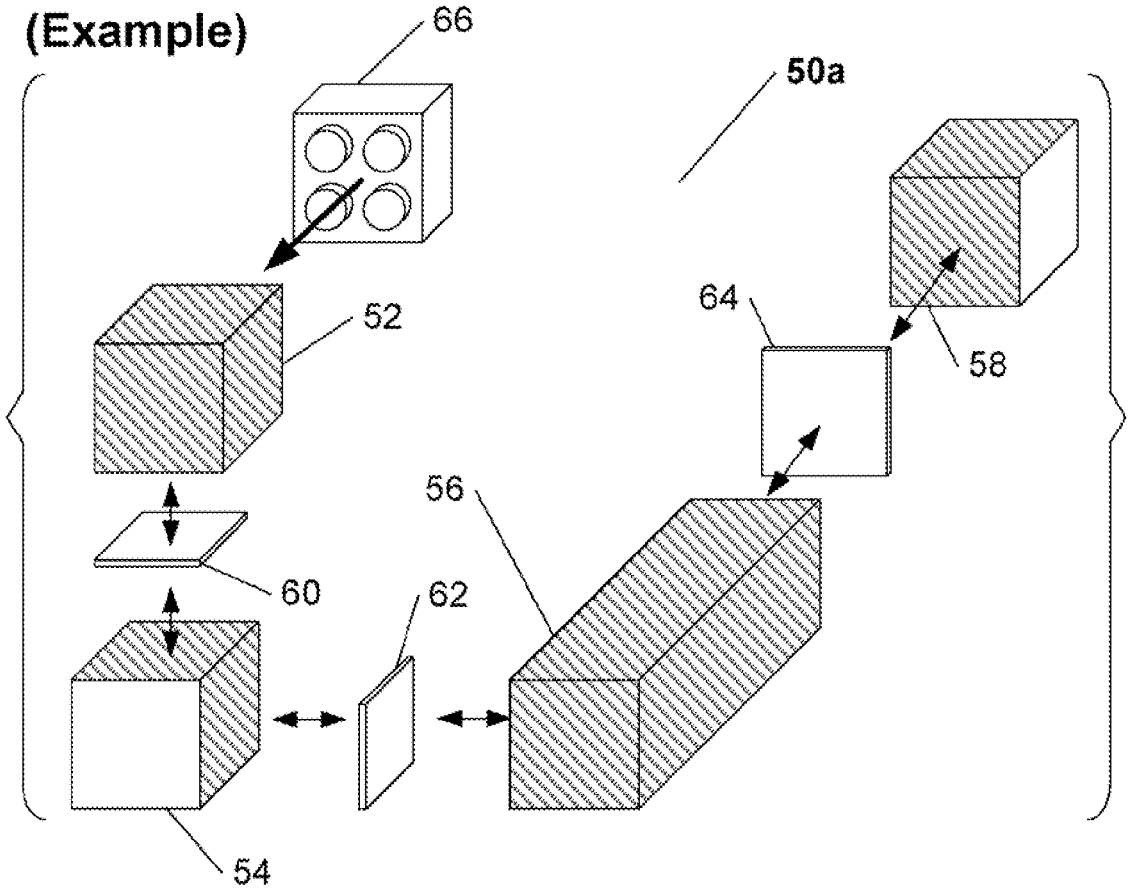
FIGS. 2A and 2B are schematic diagrams showing sequential perspective views of an exemplary utilization of multiple versatile construction components of FIG. 1A, and multiple releasable interconnect components of FIG. 1C, in a second embodiment of the inventive modular construction system, in which the connective surfaces of the versatile construction components are sized and configured to releasably connect to one or more conventional toy building elements.

Referring now to FIG. 2A a first view of an exemplary utilization of multiple versatile construction components 52-58, multiple releasable interconnect components 60-64, and a previously known toy building element 66 having a male coupling surface are all shown in a pre-connection arrangement 50*a*. For illustrative purposes, the versatile construction components 52, 54 and 58 are alternate embodiments of the construction component 10 of FIGS. 1A-1B (the construction component 52 is a cube with dimensions D1 to D3 being equal, and the construction components 54, 58 lack connective surfaces on at least one of their respective outer surfaces), while the construction component 56 is substantially equivalent to the construction component 10.

Figure 2B:
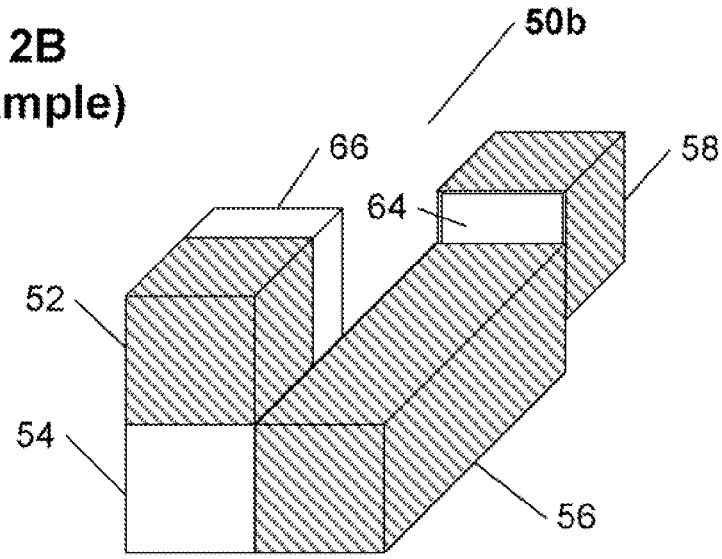
Figure 3:
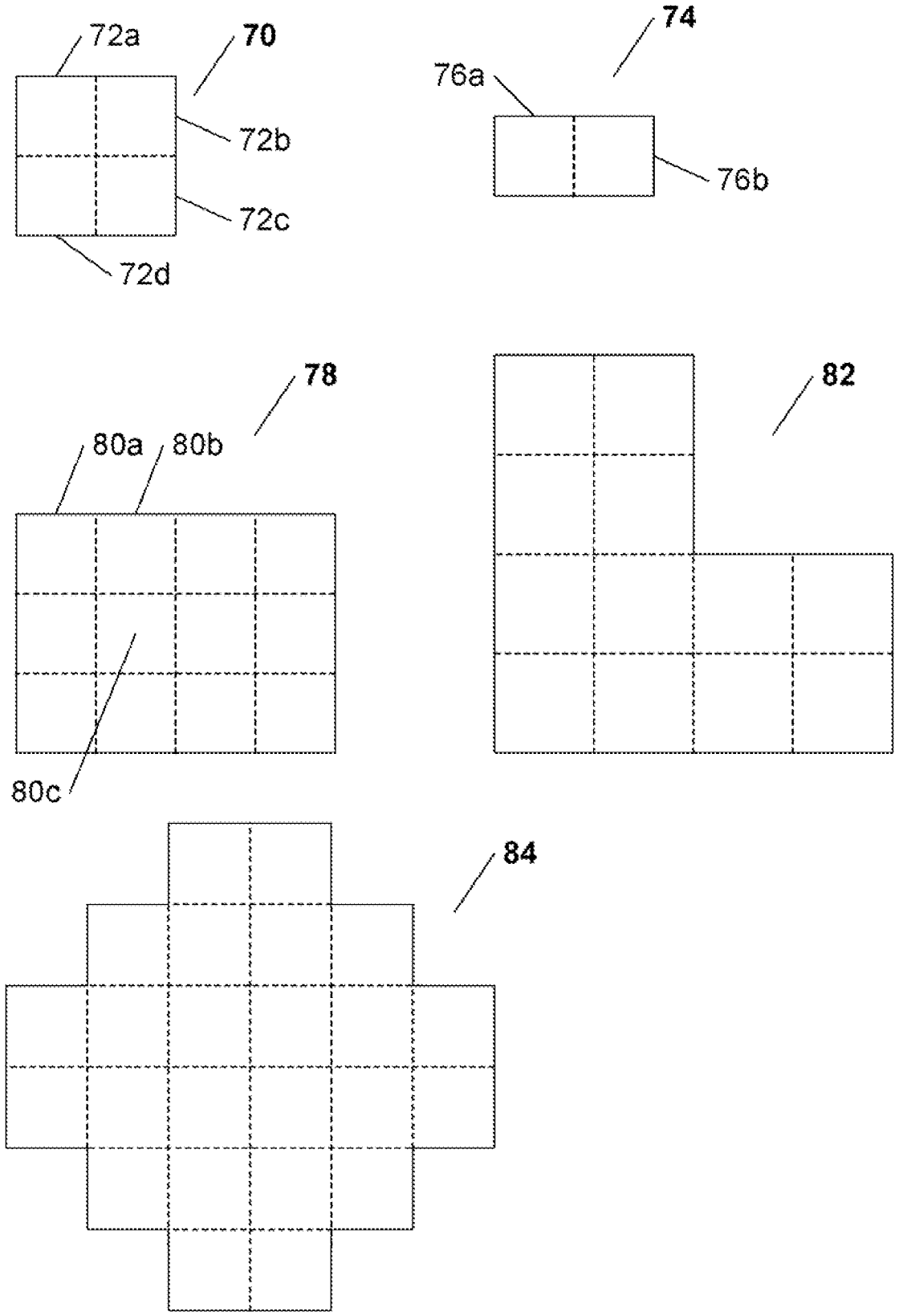
FIG. 3 is a schematic diagram showing several exemplary embodiments of inventive connective surfaces of the versatile construction component of FIG. 1A, each configured as interconnect component receiving region comprising a exemplary pattern of plural cavity elements.

Referring now to FIG. 2B, an exemplary structure 50*b* is formed by releasably connecting the multiple versatile construction components 52-58, with multiple releasable interconnect components 60-64, and releasably connecting the previously known toy building element 66 to a connective surface of the construction component 52. The structure 50*b* demonstrates the versatility of the inventive construction system, and may be readily advantageously rebuilt in a completely different configuration.

As noted above in connection with FIGS. 1A to 1D, one of the core principles of the present invention is that each construction component includes at least two inventive connective surfaces on at least two of its corresponding outer surfaces. Depending of the geometric shape of each particular outer surfaces the corresponding connective surface may vary in shape as well. Referring now to FIG. 34 several exemplary embodiments of differently shaped inventive connective surfaces 70, 74, 78, 82, and 84 are shown.

Preferably, to improve the coupling force between each receiving region and corresponding interconnect components frictionally engaged therewith, each receiving region within each corresponding connective surface, preferably comprises plural proximal cavity elements arranged in a geometric grid-like pattern that fills each corresponding connective surface to its outer edges. For example, a square connective surface 70, includes a receiving region defined by four cavity elements 72*a*-72*d*. Similarly, a small rectangular connective surface 74, includes a receiving region defined by two cavity elements 76*a*-76*b*.

While in one embodiment of the present invention, each cavity element may be the same, preferably a variety of cavity elements are utilized, each optimized for being positioned in a particular portion of the connective surface. For example, the connective surface 78 may include a corner cavity element 80*a*, optimized for a corner position, an edge cavity element 80*b*>optimized for being positioned at an edge of the connective surface 78, and a central cavity element 80*c*>optimized for being positioned within a central region of the connective surface 78. Various embodiments of different inventive cavity elements are shown and described below in connection with FIGS. 5A to 5D, while their utilization in various embodiments of connective surfaces is described below in connection with FIGS. 5E to 5K.

Figure 4A:
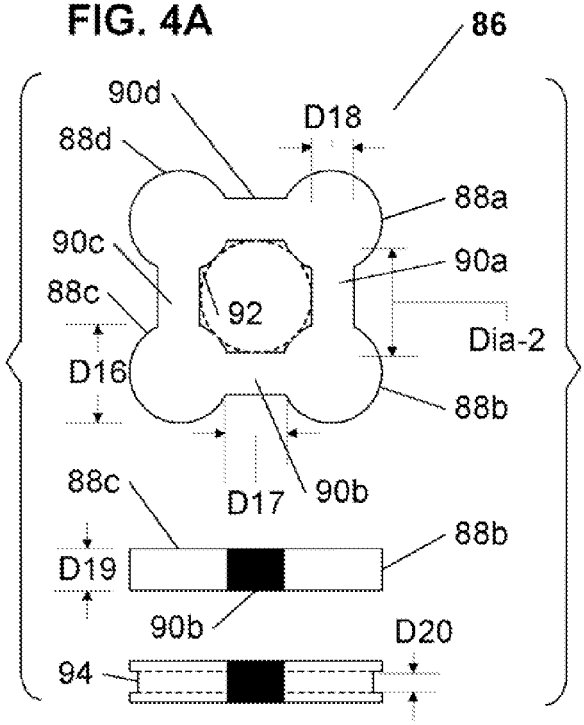
FIGS. 4A-4B are schematic diagrams showing different views of various exemplary embodiments of the inventive interconnect component sized and configured for use with various embodiments of inventive connective surfaces to releasably connect two or more inventive versatile construction components to one another.

The inventive interconnect components are of similar importance to the principles of the present invention as are the inventive connective surfaces. Referring now to FIG. 4A various views of an exemplary embodiment of an interconnect component 86 are shown. The interconnect component 86, is of a height D19, and includes tour substantially cylindrical studs 88*a*-88*d*, each of a diameter D16, with an outer side, and also includes four elongated members 90*a*-90*d*, each of a length D17 and width D18, positioned between different pairs of the studs 88*a*-88*d*: member 90*a* positioned between studs 88*a* and 88*b*, member 90*b* positioned between studs 88*b* and 88*c*, member 90*c* positioned between studs 88*c* and 88*d*, and member 90*d* positioned between studs 88*d* and 88*a*. The members 90*a* to 90*d*, and portions of the outer sides of the studs 88*a* to 88*d*, together form a hollow region 92 therebetween. In one embodiment of the present invention, the diameter Dia-2 of the hollow region 92 may be selected to facilitate frictional engagement with a cylindrical projection (such as the projection 716 of FIG. 13B) of a previously known toy building block to enable releasable attachment thereto.

Figure 4B:
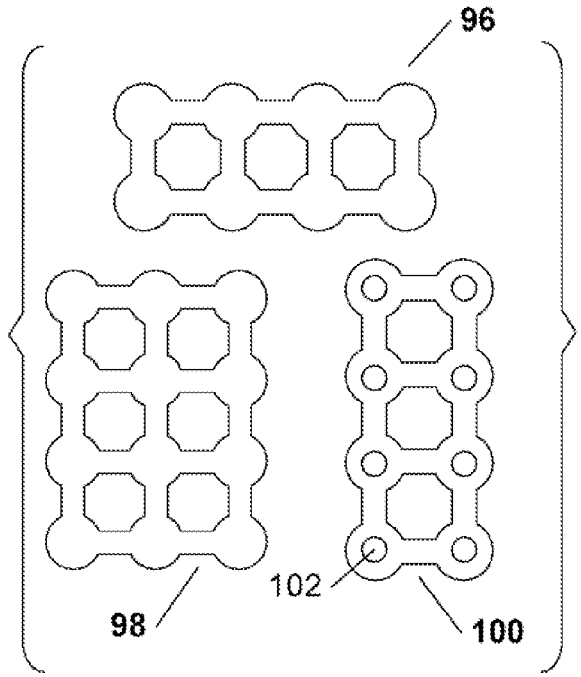

While an interconnect component 86 is shown as being square-shaped and as having four studs with four elongated members therebetween, it should be noted, that as a matter of design choice, various embodiments of inventive interconnect components can be readily provided in any geometric pattern, such as a linear pattern comprising a sequence of studs connected to one another by elongated members, or preferably, in any two-dimensional grid pattern comprising multiple studs with multiple elongated members positioned therebetween, at 90 degree or 180 degree angles with respect to one another. Referring to FIG. 4B, several exemplary larger interconnect component embodiments 96 and 98 are shown. In an alternate embodiment of the invention, to reduce weight and amount of material used, the studs of an interconnect component may be formed as hollow cylinders, shown by way of example as cylinder studs 102 in an interconnect component 100 of FIG. 4B.

In additions to facilitate detachment from receiving regions or previously known toy building elements to which the interconnect component 86 may be releasably engaged, the outer sides of the studs 88*a* to 88*d* may include corresponding notches 94, having a dimension D20 sufficient to catch and uncouple the interconnect component 86 from a coupled position.

Figure 4C:
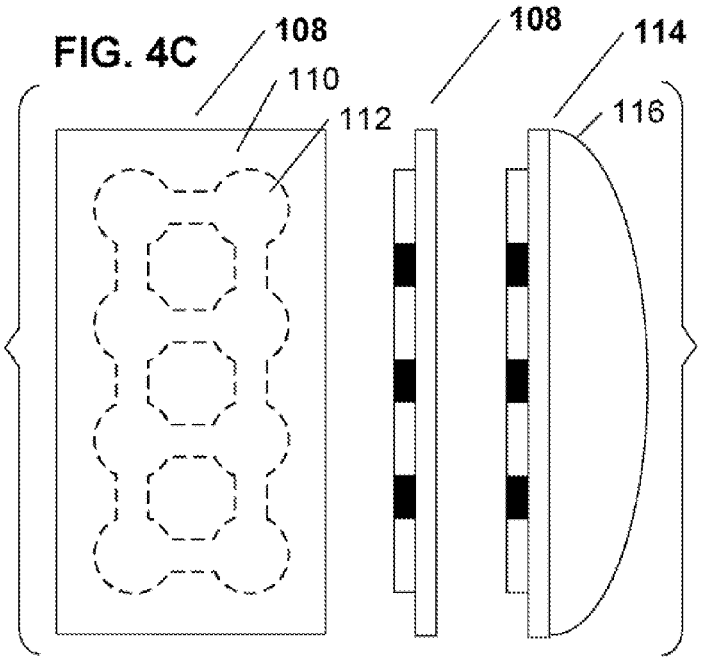
FIGS. 4C-4D are schematic diagrams showing different views of various exemplary embodiments of additional construction components that include at least one surface comprising an interconnect component disposed thereon.
Figure 4D:
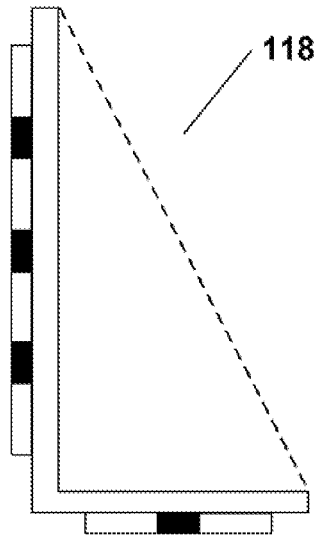

Referring now to FIG. 4C, a first alternate embodiment of the inventive interconnect component is shown as a one-sided component 108 that includes a flat plane element 110 connected at one side to an interconnect component 112. A second alternate embodiment of the inventive interconnect component is shown as a one-sided component 114, that is similar to component 108 except that it includes a shape 116 connected to the flat plane element 110. Referring now to FIG. 4D, a third alternate embodiment of the inventive interconnect component is shown as a three-dimensional exemplary "L-shaped" interconnect components with at least portions of two interconnect components being oriented at 90 degrees with respect to one another.

Figure 5A:
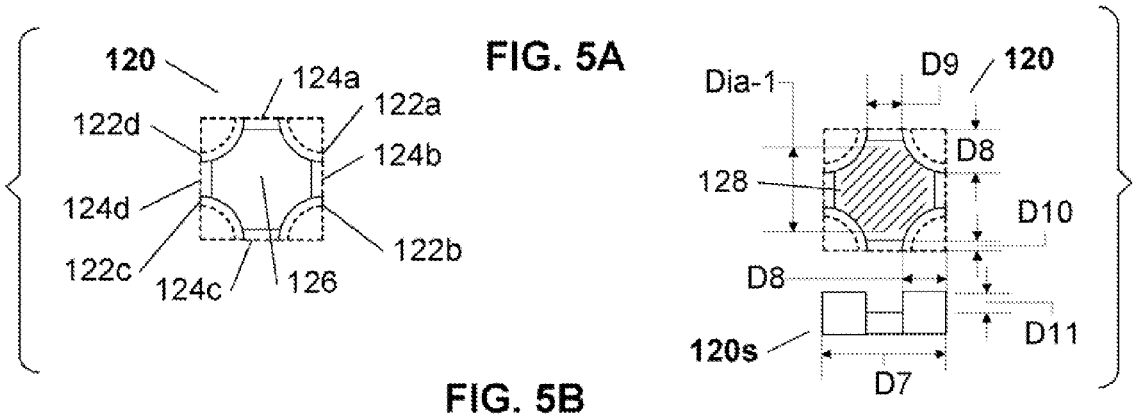
FIG. 5A is a schematic diagram showing various views of a first embodiment of an inventive cavity element, a plurality of which may be utilized as a pattern in the connective surfaces of the versatile construction component of FIG. 1A.

Referring now to FIG. 5A, various views are shown of a first embodiment of an inventive cavity element 120, that may be utilized as part of a cavity element pattern in receiving regions of the connective surfaces of the various embodiments of the inventive construction components. The cavity element 120 comprises a first internal hollow region 126 bounded by a four corner friction elements 122*a*-122*d*, each of a dimension D8, where the hollow region 126 and the friction elements 122*a*-122*d* are sized and configured to receive therein, and releasably frictionally engage, one of the studs of an interconnect component in a coupling region 128, such as any of the studs 88*a* to 88*d* of the interconnect component 86 of FIG. 4A. The corner friction elements

122*a*-122*d* are preferably substantially quarter-cylindrical, such that when vertices of four corner elements of four different cavity elements are placed in contact with one another, together they form a cylindrical element of a diameter substantially equal to two times D8.

In addition, the cavity element 120 also includes ribs 124*a* to 124*d* each of a length D9 and a thickness D10, and each positioned at outer boundaries of the cavity element 120, proximal to the bottom of the hollow region 126 and between respective friction elements 122*a*-122*d*, to define a plurality of secondary hollow regions between each proximal pair of the friction elements, each secondary hollow region being of a depth D11 and a width D9 (see a side view of cavity element 120 in FIG. 5A, shown as cavity element 120*s*). Preferably, each secondary hollow region is sized and configured (e.g., by selecting appropriate values for D9, D11, D18, and D19), to receive therein and to releasably frictionally engage one of the elongated members, such as any of the members 90*a* to 90*d* of FIG. 4A.

Figure 5B:
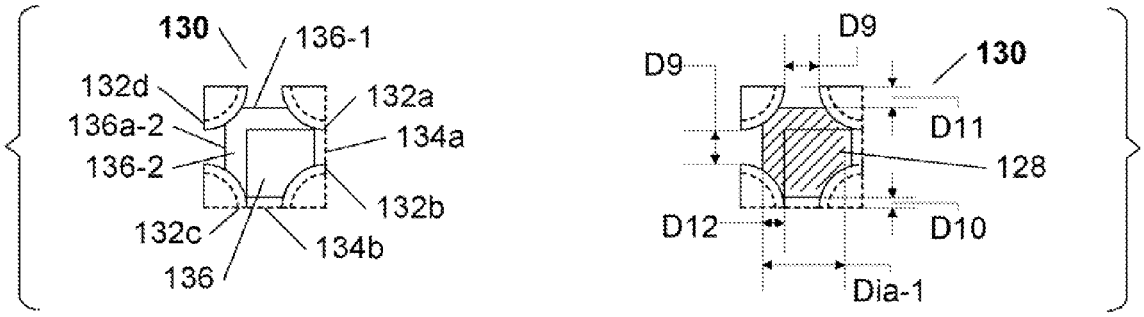
FIG. 5B is a schematic diagram showing various views of a second embodiment of the inventive cavity element that is optimized for positioning and utilization use at one or more of the corners of the connective surfaces of the versatile construction component of FIG. 1A.
Figure 5C:
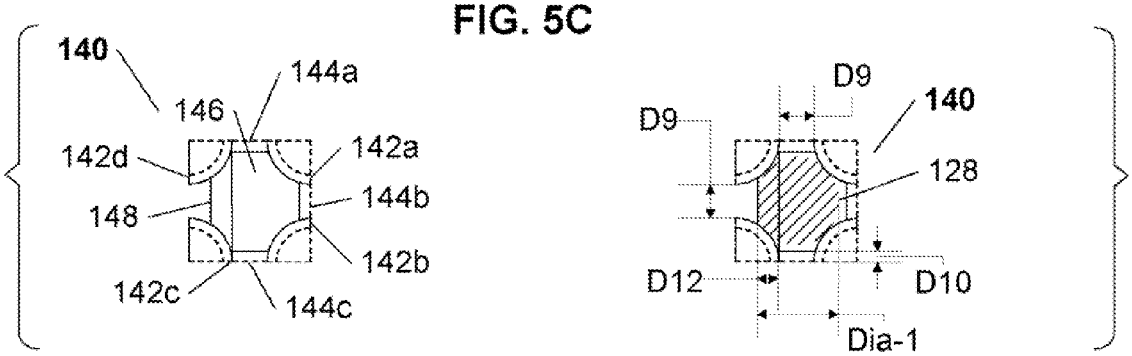
FIG. 5C is a schematic diagram showing various views of a third embodiment of the inventive cavity element that is optimized for positioning and utilization at one or more of the edges of the connective surfaces of the versatile construction component of FIG. 1A.
Figure 5D:
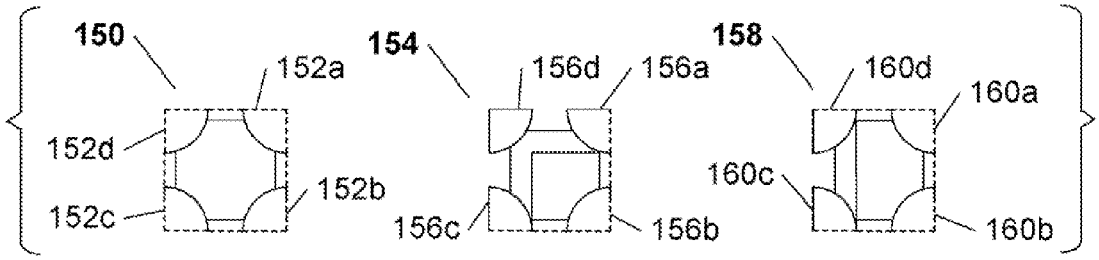
FIG. 5D is a schematic diagram showing various alternate embodiments of the inventive cavity elements of FIGS. 5A to 5C.
Figure 5E:
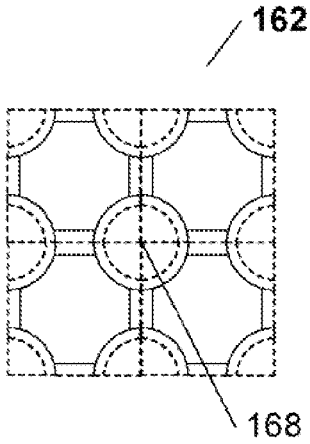
FIG. 5E is a schematic diagram showing a first exemplary embodiment of a connective surface of the versatile construction component of FIG. 1A configured utilizing multiple inventive cavity elements of FIG. 5A.

As discussed below in connection with FIGS. 5E to 5H, the cavity element 120 is optimized for deployment in a substantially central region of a respective connective surface (see FIG. 5H), but may be readily deployed throughout an entire connective surface (as shown in FIG. 5E).

Referring now to FIG. 5B, various views are shown of a second embodiment of an inventive cavity element 130, that may be utilized as part of a cavity element pattern, in receiving regions of the connective surfaces of the various embodiments of the inventive construction components. The cavity element 130 comprises a first internal hollow region 136 bounded by a four corner friction elements 132*a*-132*d* each of a dimension D8, where the hollow region 136 and the friction elements 132*a*-132*d* are sized and configured to receive therein, and releasably frictionally engage, one of the studs of an interconnect component, such as any of the studs 88*a* to 88*d* of the interconnect component 86 of FIG. 4A. The corner friction elements 132*a*-132*d* are preferably substantially quarter-cylindrical, such that when vertices of four corner elements of four different cavity elements are placed in contact with one another, together they form a cylindrical element of a diameter substantially equal to two times D8.

In addition, the cavity element 130 also includes a first narrow rib 134*a* positioned between friction elements 132*a* and 132*b*, and a second narrow rib positioned between the friction elements 132*b* and 132*c*. Each of the narrow ribs 134*a* and 134*b* is of a length D9 and a thickness D10, and each is positioned at two of outer boundaries of the cavity element 130 and proximal to the bottom of the hollow region 136, to define a pair of secondary hollow regions between each proximal pair of the friction elements bridged by the ribs 134*a*, 134*b*, each secondary hollow region being of a depth D11 and a width D9. Preferably, each secondary hollow region is sized and configured (e.g. by selecting appropriate values for D9, D11, D18, and D19), to receive therein and to releasably frictionally engage one of the elongated members, such as any of the members 90*a* to 90*d* of FIG. 4A. The cavity element 130 also includes a corner element 136 composed of two ribs 136-1 and 136-2 each of a width D11, disposed at a 90 degree angle with respect to one another. The corner element 136 is positioned to define an additional pair of secondary hollow regions between each proximal pair of the friction elements bridged by the ribs 136-1, 136-2, each additional secondary hollow region being of a depth D11 and a width D9.

As discussed below in connection with FIGS. 5G to 5K, the cavity element 130 is optimized for deployment at corners of a respective connective surface (see FIGS. 5G to 5K).

Referring now to FIG. 5C, various views are shown of a third embodiment of an inventive cavity element 140, that may be utilized as part of a cavity element pattern, in receiving regions of the connective surfaces of the various embodiments of the inventive construction components. The cavity element 140 comprises a first internal hollow region 146 bounded by a four corner friction elements 142*a*-142*d*, each of a dimension D8, where the hollow region 146 and the friction elements 142*a*-142*d* are sized and configured to receive therein, and releasably frictionally engage, one of the studs of an interconnect component, such as any of the studs 88*a* to 88*d* of the interconnect component 86 of FIG. 4A. The corner friction elements 142*a*-142*d* are preferably substantially quarter-cylindrical, such that when vertices of four corner elements of four different cavity elements are placed in contact with one another, together they form a cylindrical element of a diameter substantially equal to two times D8.

In addition, the cavity element 140 also includes a first narrow rib 144*a* positioned between friction elements 142*a* and 142*b*, a second narrow rib positioned between the friction elements 142*b* and 142*c*, and a third narrow rib positioned between the friction elements 142*d* and 142*a*. Each of the narrow ribs 144*a*-144*c* is of a length D9 and a thickness D10, and each is positioned at three of outer boundaries of the cavity element 140 and proximal to the bottom of the hollow region 146, to define three secondary hollow regions between each proximal pair of the friction elements bridged by the ribs 144*a*, 144*b*, and 144*c*, respectively, each secondary hollow region being of a depth D11 and a width D9. Preferably, each secondary hollow region is sized and configured (e.g., by selecting appropriate values for D9, D11, D18, and D19), to receive therein and to releasably frictionally engage one of the elongated members, such as any of the members 90*a* to 90*d* of FIG. 4A. The cavity element 140 also includes an outer rib element 148 of a width D11. The outer rib element 148 is positioned to define an additional secondary hollow region between the proximal pair of the friction elements 142*c* and 142*d*, the additional secondary hollow region being of a depth D11 and a width D9.

As discussed below in connection with FIGS. 5F, and 5G to 5K, the cavity element 140 is optimized for deployment at corners of a respective connective surface.

While the various friction elements shown in FIGS. 5A to 5C are shown as being configured as quarter walls of a hollow cylinder, the friction elements may be solid as well. Referring now to FIG. 5D, alternate embodiments of cavity elements 120, 130, and 140 are shown as cavity elements 150, 154, and 15, each including having respective corner friction elements 152*a*-152*d*, 156*a*-156*d*, and 160*a*-160*d* that are solid.

In different embodiments of the present invention, the connective surfaces may have receiving regions comprising multiple individual interconnected cavity elements (e.g., any of the cavity elements 120-158 may be thus utilized), and/or may also have receiving regions formed from multiple integral cavity elements. In addition, cavity elements of a single type may be used to form a desired receiving region, such as a connective surface 162 shown in FIG. 5E, that utilizes four cavity elements 120, a connective surface 164 shown in FIG. 5F, that utilizes four cavity elements 140, and a connective surface 166 shown in FIG. 5G, that utilizes four cavity elements 130.

Figure 5F:
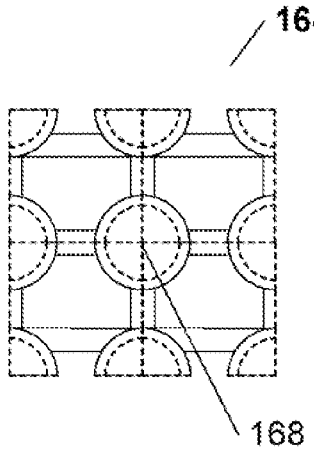
FIG. 5F is a schematic diagram showing a second exemplary embodiment of a connective surface of the versatile construction component of FIG. 1A, configured utilizing multiple inventive cavity elements of FIG. 5C.
Figure 5G:
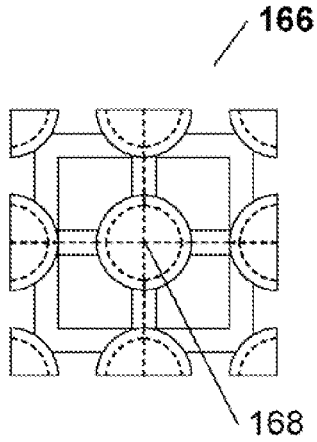
FIG. 5G is a schematic diagram showing a third exemplary embodiment of a connective surface of the versatile construction component of FIG. 1A, configured utilizing multiple inventive cavity elements of FIG. 5B

In one embodiment of the present invention, in each of the connective surfaces 162 to 166 of FIGS. 5E to 5G, certain adjoining corner friction elements of four adjoining cavity elements may form a cylindrical element 168 (integral or otherwise), which, if the respective connective surface is part of a hollow or skeletal construction component, may extend into, and/or through the construction component. This arrangement may be advantageous in certain applications because various elongated elements (such as rods, dowels, axles (e.g., for wheels), cabling, etc.) may be inserted though one or more sequentially positioned construction components through their corresponding aligned cylindrical elements 168.

Figure 5H:
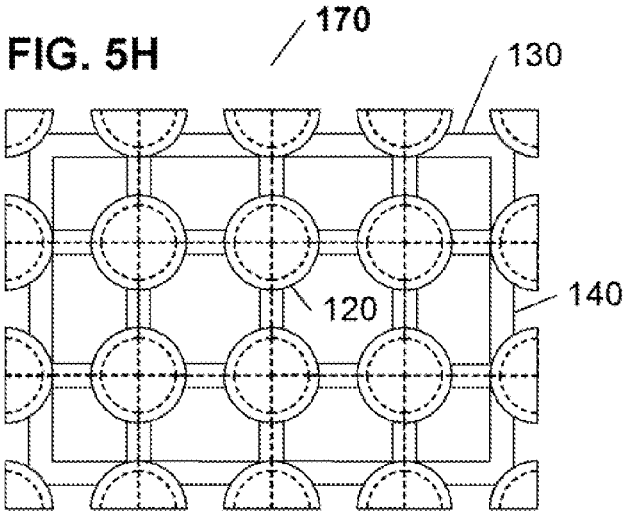
FIG. 5H is a schematic diagram showing a fourth exemplary embodiment of a connective surface of the versatile construction component of FIG. 1A configured utilizing multiple optimally positioned inventive cavity elements of FIGS. 5A to 5C.
Figure 5I:
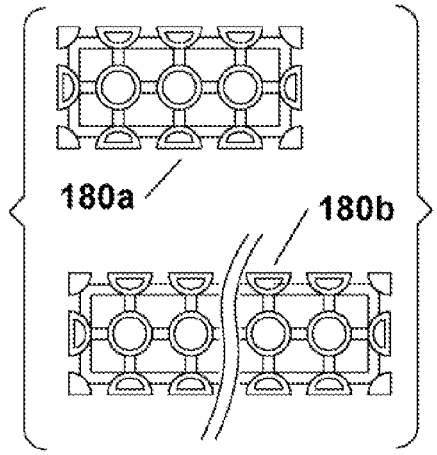
FIGS. 5I to 5K are schematic diagrams showing additional exemplary embodiments of continuously formed connective surfaces utilizing respective patterns that correspond to two or more embodiments of cavity elements of FIGS. 5A to 5C.
Figure 5J:
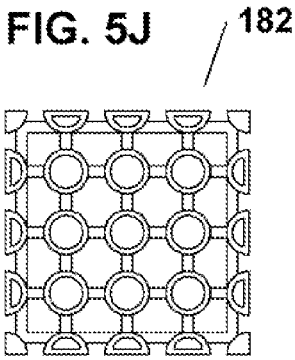
Figure 5K:
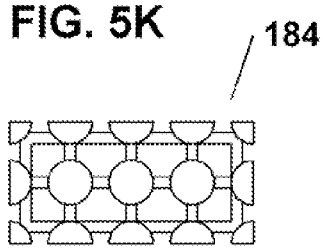

Preferably, where possible, connective surfaces comprise receiving regions formed by optimally positioned cavity element types, as demonstrated by a connective surface 170 of FIG. 5H, that includes corner cavity elements 130, edge cavity elements 140, and central cavity elements 120. Examples of additional exemplary embodiments of continuously formed connective surfaces utilizing respective patterns that correspond to two or more embodiments of cavity elements of FIGS. 5A to 5C are shown in FIGS. 5I to 5K.

Figure 6A:
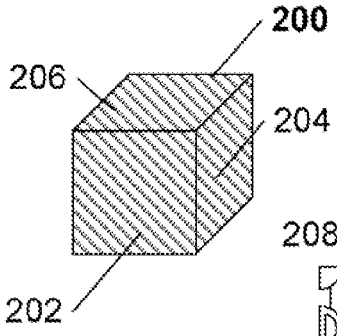
FIGS. 6A to 7 are schematic diagrams showing various exemplary embodiments of the versatile construction component of FIG. 1A utilizing one or more connective surface embodiments of FIGS. 5E to 5J.
Figure 6B:
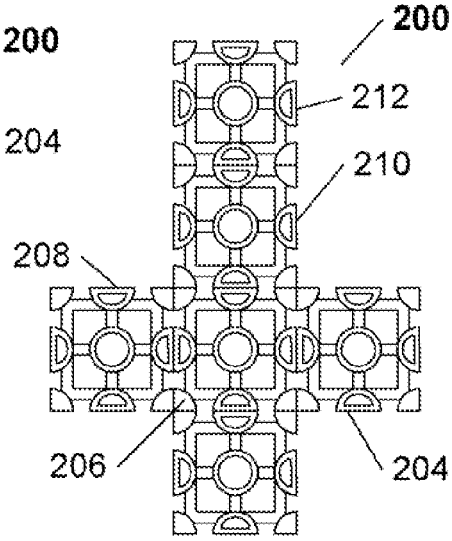
Figure 6C:
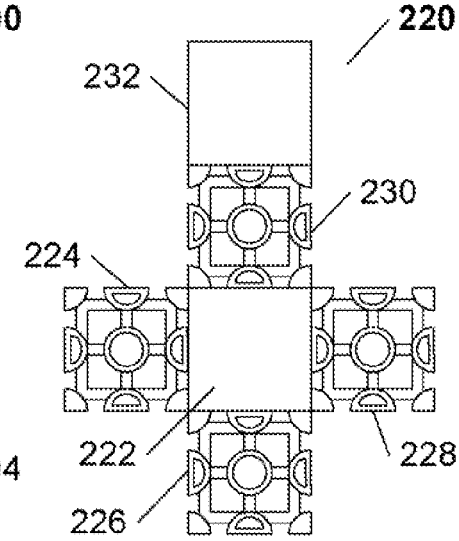
Figure 7:
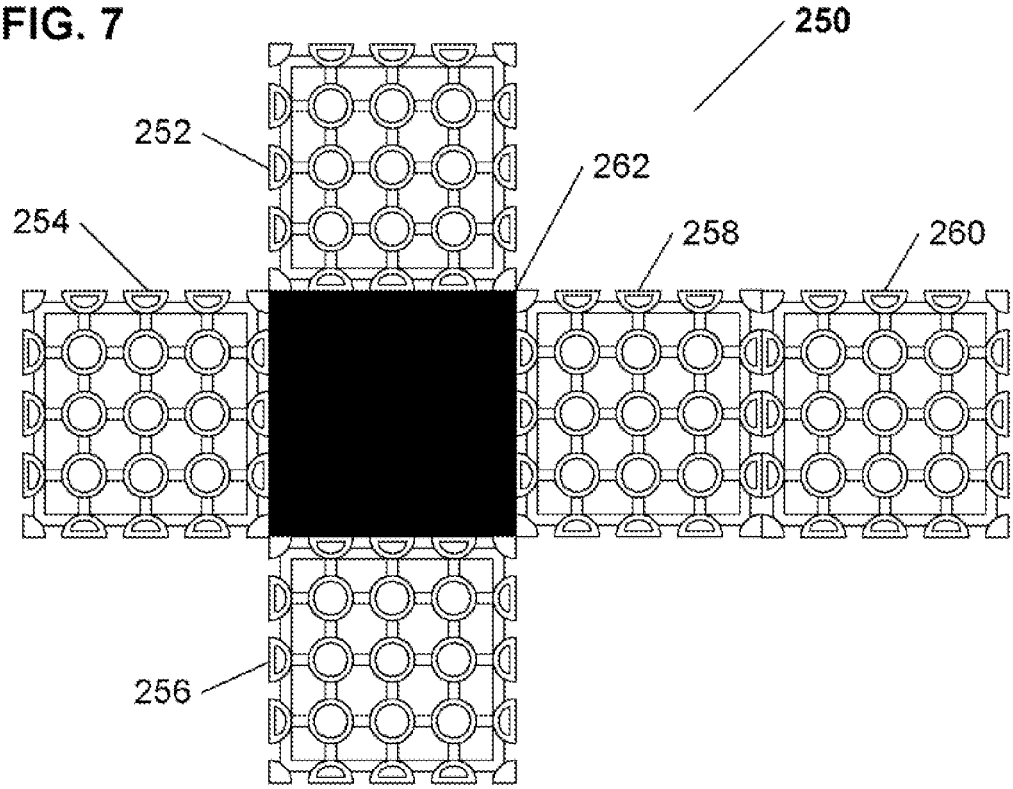

Referring now to FIGS. 6A and 6B, an exemplary embodiment of inventive construction component 200 is shown in an isometric view with connective surfaces 202-212 serving as the component 200 outer surfaces. FIG. 6C shows an alternate embodiment of the construction component 200, as a construction component 220 with four outer side walls comprising respective connective surfaces 224 to 230, and with blank top and bottom surfaces 222, 232. Referring now to FIG. 7, an exemplary embodiment of a hollow construction component 250 having five outer walls forming five connective surfaces 252 to 260, and having an opening 262 into the hollow interior. The construction component 250 may be sized and configured to serve as storage furnishing, and may also be interconnected with additional hollow components utilizing appropriately sized interconnect components, to form a furnishing or storage system (for an additional example of utilization of the inventive construction system for building furnishings, please refer to the FIG. 12 and accompanying text below).

Referring now to FIGS. 8A and 8B an alternate exemplary embodiment of the inventive versatile construction component 300 is shown, in which the construction component 300 comprises integral connective surfaces, where each integral connective surface may only be coupled to other connective surfaces utilizing at least one interconnect component, such as the interconnect component 86, that fits entirely within the region defined by the outer boundaries of the integral connective surface.

The construction component 300 is substantially similar in principle and operation to the previously described construction component 200 of FIGS. 6A-6B, that utilizes connective surfaces 202-212, that wrap around its outer walls allowing overlapping connection to other construction components utilizing one or more interconnect components. However, the outer edges of the component 300 form a frame 302 that defines outer boundaries for the corresponding receiving region of each connective surface 304*a* to 304*f*, such that interconnect components can only be utilized within each receiving region, but cannot span across the frame 302. While this configuration makes the construction component 300 less versatile that previously described embodiments, its outer frame 302 provides significant stability and protection for the interior structure, and may thus be useful in certain applications.

By way of example, FIG. 8A also shows a detailed view of one of the component 300 connective surfaces 304*e*. The connective surface 304*e* comprises a receiving region 306 therein, that includes a centrally positioned central cylindrical element 310, a frame 302 surrounding the element, and four notched ribs 314*a* to 314*d* each being of length D13 (each having a respective notch portion 314*a* to 314*d* of length D14, and an un-notched portion 312*a* to 312*d* of a length D15), positioned in a cross formation radiating from the cylindrical element 310 and the four inner portions of the frame 302, thus separating the receiving region 306 into four proximal hollow portions, each sized and configured to produce a frictional coupling region 316 of diameter Dia-1 capable of releasable engagement with a corresponding stud of a interconnect component inserted therein. Preferably, each notch portions 314*a* to 314*d* is sized and configured to releasably frictionally engage a corresponding elongated member of an interconnect component.

Figure 8C:
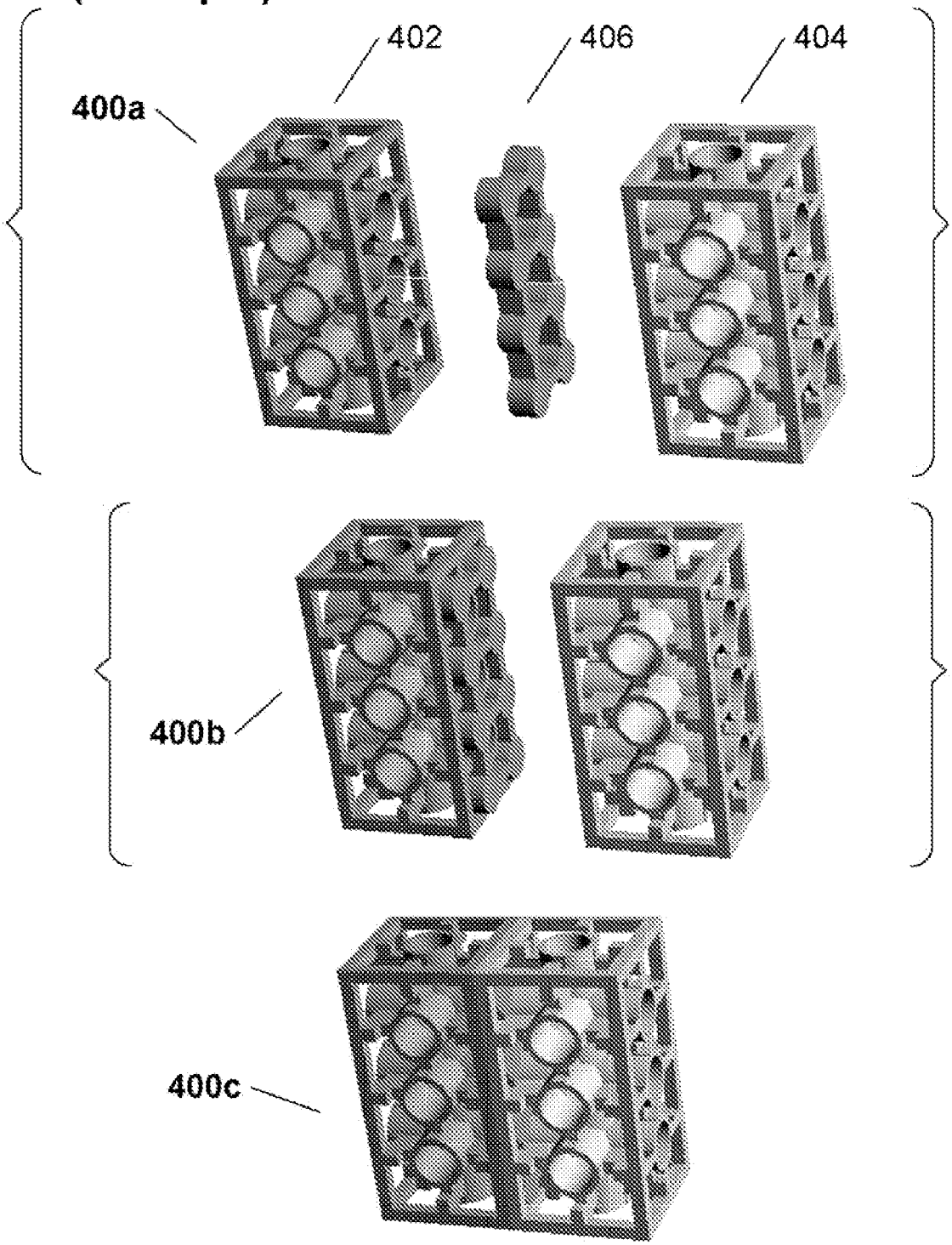
FIG. 8C is an exemplary schematic diagram illustrating sequential views of a process of connection of two exemplary construction components of FIGS. 8A-8B utilizing an interconnect component of FIG. 48.

As discussed above in connection with FIGS. 5E to 5G, the central cylindrical element 310 may be hollow and extend into, and/or through the construction component 300 (as also shown by way of example in FIG. 8C). This arrangement may be advantageous in certain applications because various elongated elements (such as rods, dowels, axles (e.g., for wheels), cabling, etc.) may be inserted though one or more sequentially positioned construction components 300 through their corresponding aligned cylindrical elements 310.

Referring now to FIG. 8C, several sequential views of a process of connection of two exemplary construction components 402 and 404, each substantially identical to the component 300 of FIGS. 8A-8B, utilizing an interconnect component 406, substantially identical to the interconnect component 96 of FIG. 4B. At a first stage 400*a*, the construction components 402 and 404 are aligned with one another and the interconnect component 406 is positioned therebetween; at a second stage 400*b*, the interconnect component 406 is partially inserted into the receiving region of the component 402, with one of its coupling surfaces exposed, and at a stage 400*c*, the component 404 is brought into releasable frictional engagement with the exposed coupling surface of the interconnect component 406, thus releasably connecting the construction components 402 and 404 to one another.

Referring now to FIGS. 9A to 9C an exemplary releasable connection of two versatile construction components of FIGS. 6A-6C (shown as construction components 502 and 504) to one another utilizing the interconnect component of FIG. 4A (shown as an interconnect component 506) is shown. A side view 500*a* shows the components being brought into releasable contact with one another, a side view 500*b* shows the construction components 502 and 504 coupled to one another, with the interconnect component 506 being positioned completely within a cavity formed by the overlapping receiving regions of the components 502 and 504, and a top-down view 500*c* shows the position of the interconnect component 506 within the construction components 502 and 504.

Referring now to FIGS. 10A to 10B, an exemplary releasable connection exemplary releasable connection of a versatile construction component of FIGS. 6A-6C (shown as construction component 522), to two different predetermined previously known toy building elements, each having coupling studs disposed on one of their surfaces (shown as building blocks 524 and 526). A side view 520*a* shows the component 522 and the building blocks 524 and 526 being brought into releasable contact with one another, and a side view 520*b* shows the construction components 522 coupled with the building blocks 524, 526.

Referring now to FIG. 11, an exemplary releasable connection process 550 is shown, where multiple versatile construction components 554, 556, and 558 (similar in construction to the construction components of FIGS. 6A-6C), and a construction component 552 of FIGS. 8A-8B, are coupled to one another in a variety of configurations and orientations through different interconnect components 560-568, The process 550 also illustrates releasable connection between multiple predetermined previously known toy blocks 570 and 572, each having coupling studs disposed on one of their surfaces, and different connective surfaces of various inventive construction components.

Figure 12:
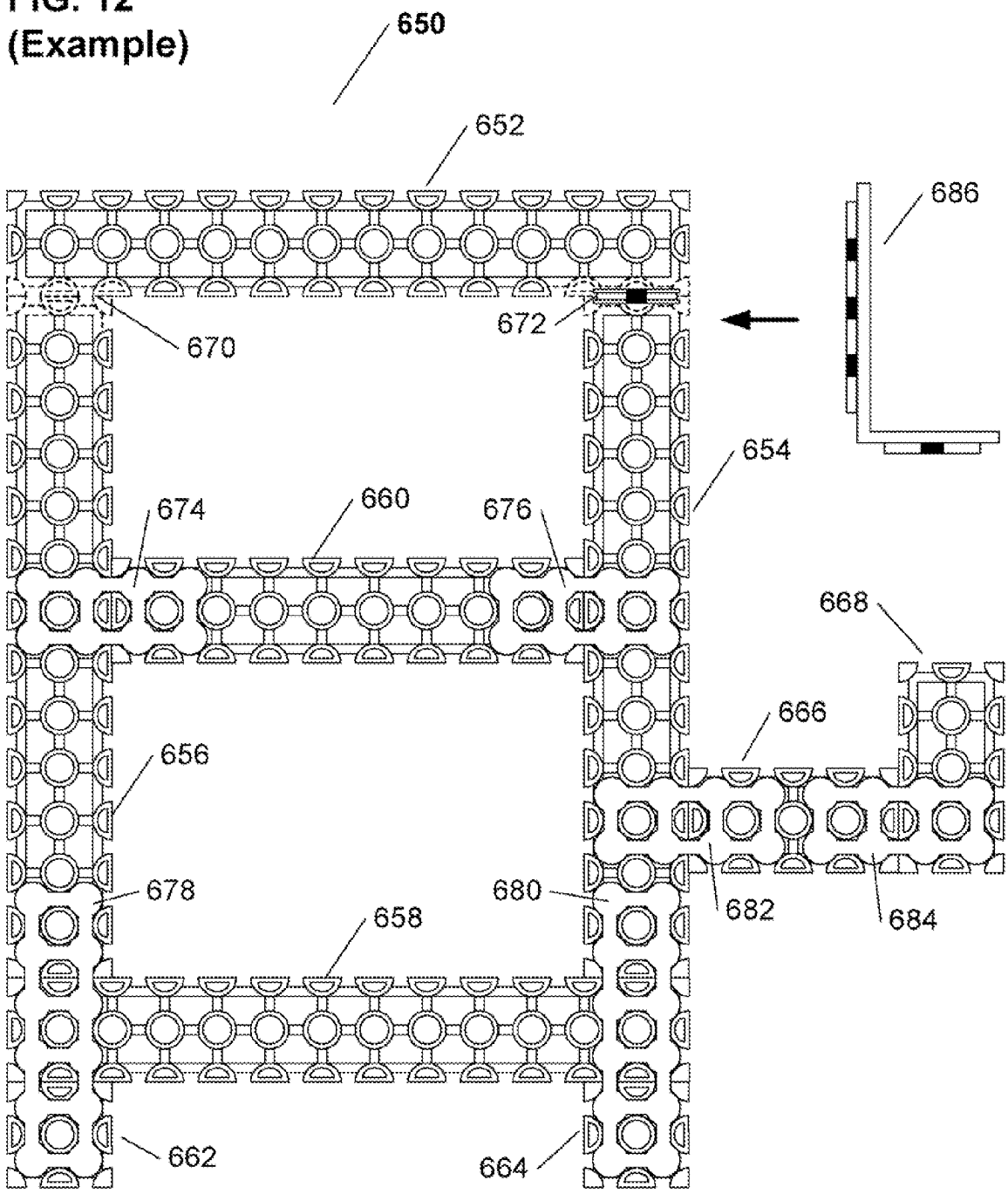
FIG. 12 is an exemplary schematic diagram illustrating an exemplary utility structure constructed utilizing various embodiments of inventive versatile construction components releasably connected with various embodiments of interconnect components.

Referring now to FIG. 12, an exemplary furnishing structure 650 is shown to demonstrate the versatility of flexibility of the inventive construction system. The furnishing structure 650 is constructed utilizing multiple construction components 652 to 664 and multiple interconnect components 670 to 680 for the basic structure with who shelves and legs, and utilizing additional construction components 666 and 668 along with interconnect components 682, 684 to form a side shelf. An additional optional shelf 686 may also be releasably attached to any side of the structure 650

Thus, while there have been shown and described and pointed out fundamental novel features of the invention as applied to preferred embodiments thereof, it will be understood that various omissions and substitutions and changes in the form and details of the devices and methods illustrated, and in their operation, may be made by those skilled in the art without departing from the spirit of the invention. For example, it is expressly intended that all combinations of those components and/or method steps which perform substantially the same function in substantially the same way to achieve the same results are within the scope of the invention. It is the intention, therefore, to be limited only as indicated by the scope of the claims appended hereto.

We claim:

1. A modular construction system, comprising:

a plurality of construction components, each said plural construction component comprising a plurality of single type of planar connective surfaces, each disposed at a predefined angle to one another, and each comprising a receiving region therein disposed along substantially entire area of said corresponding planar connective surfaces; and at least one interconnect component, comprising:

a plurality of coupling elements forming a first substantially planar coupling surface, each said plural coupling element comprising:

a plurality of substantially cylindrical studs, each having an outer side, and at least one elongated member connected to two of said plural studs at said corresponding outer sides thereof, such that said plural studs and said at least one elongated member form a two-dimensional pattern selected from a group of:

a linear pattern comprising a sequence of said plural studs connected to one another by said at least one elongated member, or a two-dimensional grid pattern comprising a plurality of said studs interconnected with a plurality of said elongated members each positioned at a 90 degree or a 180 degree angle with respect to one another, and a second substantially planar coupling surface, oriented in an opposite direction of said first coupling surface, wherein said plural coupling elements are sized and configured to only partially enter and frictionally engage at least a portion of each said plural receiving region, to enable a releasable coupling connection between said plural construction components, each said plural receiving region comprising at least one cavity element operable to receive and releasably engage only a portion of one of said plural coupling elements, and wherein said plural connective surfaces and said corresponding plural receiving regions are sized and configured to enable a first connection configuration in which at least two of said plural construction components are positioned and oriented to form an overlap region so that at least portions of respective plural connective surfaces of each of said at least two plural construction components face one another to form a joint receiving region defined by respective plural overlapping receiving regions, wherein at least a portion of said interconnect component is positioned within said joint receiving region, such that at least a portion of said plural coupling elements along said first coupling surface enters, and releasably engages, at least a portion of one of said overlapping plural receiving regions, while at least a portion of said plural coupling elements along said second coupling surface enters, and releasably engages at least a portion of another of said plural overlapping receiving regions, thereby enabling said overlapping plural connective surfaces of said connected construction components to be in substantial contact with one another in said overlapping region.

2. The modular construction system of claim 1, wherein said plural connective surfaces and said corresponding plural receiving regions are further sized and configured to enable a second connection configuration in which at least two of said plural construction components are positioned proximal to one another to align one each of their respective plural connective surfaces in the same coordinate plane to form a corresponding plurality of proximal receiving regions, wherein at least a portion of said plural coupling elements of one of said first and second coupling surfaces of said interconnect component, is positioned within and releasably engages at least a portion of each of said plural proximal receiving regions, thereby releasably connecting said plural proximal aligned construction components.

3. The modular construction system of claim 1, wherein at least one of said plural construction components comprises: a building element having at least two substantially flat outer surfaces, and at least two planar elements positioned on said at least two substantially flat outer surfaces, each comprising said single type plural connective surface.

4. The modular construction system of claim 3, wherein said building element comprises a three-dimensional geometric shape, and wherein said building element is at least one of: hollow, solid, and/or filled with a predetermined material.

5. The modular construction system of claim 3, wherein said at least two planar elements are formed integrally with said outer surfaces of said building element.

6. The modular construction system of claim 1, wherein at least one of said plural construction components comprises: a patterned three-dimensional geometric structure configured to form at least two of said single type plural connective surfaces on at least two of its outer surfaces.

7. The modular construction system of claim 1, wherein each said cavity element comprises:

a first hollow region bounded by a plurality of first friction elements, sized and configured to receive therein and releasably frictionally engage one of said plural studs; and a plurality of second hollow regions defined between at least a proximal pair of said first plural friction elements each sized and configured to receive therein and releasably frictionally engage one of said at least one elongated members.

8. The modular construction system of claim 7, wherein each said first plural friction element comprises at least a quarter-cylindrically shaped wall oriented toward a center of said first hollow region, such that at least a portion of said outer side of one of said plural studs entering said hollow region frictionally engages at least a portion of each of said plural at least quarter-cylindrically shaped walls.

9. The modular construction system of claim 8, further comprising a plurality of rib elements, each connected to at least two of said plural friction elements, and each positioned at a bottom of each said plural second hollow region.

10. The modular construction system of claim 9, wherein each said receiving region comprises at least one of: of plurality of corner receiving regions, a plurality of edge receiving regions, and/or a central receiving region, and wherein said at least one cavity element comprises at least one of:

a plurality of corner cavity elements sized and configured for optimal deployment at a corner of each said plural connective surface;

a plurality of edge cavity elements sized and configured for optimal deployment at an edge of each said plural connective surface; and/or a plurality of other cavity elements sized and configured for optimal deployment at said central receiving region.

11. The modular construction system of claim 7, for use in conjunction with toy building elements each having at least one cylindrical stud connector positioned on surface thereof, wherein each said first hollow region of each said at least one coupling element is sized and configured to receive therein and releasably frictionally engage a corresponding one of said at least one cylindrical stud connectors.

12. The modular construction system of claim 1, wherein said outer side of at least a portion of said studs comprises a notch operable to facilitate disengagement of said interconnect component from releasable connection to said at least one corresponding cavity elements.

13. The modular construction system of claim 1, wherein at least two opposing plural connective surfaces of at least one plural construction component comprise at least one hollow cylindrical channel therebetween, enabling any element inserted therein to pass through said at least one plural construction component.

14. The modular construction system of claim 13, wherein at least a portion of said plural construction components each comprise said at least one hollow cylindrical channel, such that when at least two of said portion of said plural construction components are positioned proximal to one another so that said respective hollow cylindrical channels are aligned, any element inserted into a first cylindrical channel can freely pass through said aligned subsequent cylindrical channels.

* * * * *